United States Patent [19]

Kwasnik et al.

[11] Patent Number: 4,552,622

[45] Date of Patent: Nov. 12, 1985

[54] CLEANING APPARATUS FOR THE SEALING SURFACES OF LEVELING DOORS AND LEVELING DOOR FRAMES OF BATTERY-TYPE COKE OVENS

[75] Inventors: Hans-Jurgen Kwasnik, Herne; Hans-Gunter Piduch, Bochum, both of Fed. Rep. of Germany

[73] Assignee: Dr. C. Otto & Comp. G.m.b.H., Bochum, Fed. Rep. of Germany

[21] Appl. No.: 605,893

[22] Filed: May 1, 1984

[30] Foreign Application Priority Data

May 11, 1983 [DE] Fed. Rep. of Germany ..... 3317185

[51] Int. Cl.[4] ..... C10B 43/00

[52] U.S. Cl. ..... 202/241; 110/173 R; 122/379; 134/178; 134/181; 201/2; 202/242

[58] Field of Search ..... 202/241, 262, 242; 201/1, 2; 110/173 R, 176, 177, 181; 122/379, 390; 239/178, 184, 186, 225, 264; 134/178, 180, 181; 196/122; 432/250, 247, 65, 237

[56] References Cited

U.S. PATENT DOCUMENTS 2,986,758 6/1961 Randell et al. ..... 202/241

FOREIGN PATENT DOCUMENTS 2143595 3/1973 Fed. Rep. of Germany ..... 202/241
3236151 4/1984 Fed. Rep. of Germany ..... 202/241
57-195788 5/1981 Japan ..... 202/241
59030884 8/1982 Japan ..... 202/241

*Primary Examiner*—Jay H. Woo
*Assistant Examiner*—Mike McGurk
*Attorney, Agent, or Firm*—Thomas H. Murray

[57] ABSTRACT

Means for cleaning the sealing surfaces of coke oven leveling doors and frames, the cleaning means being installed on a coke-pushing machine without any increase in the normal overall length thereof. A carriage extends between and is movable along guideways mounted on the side walls of a surrounding casing, the carriage being provided with liquid nozzles adapted to be directed at the sealing surfaces of the leveling door frame and the sealing surfaces of the leveling door when rotated upwardly. Nozzles are connected through hoses to a supply of high-pressure liquid, the arrangement being such that as the carriage moves along the guideways, high-pressure liquid issuing from the nozzles will clean the sealing surfaces of a leveling door frame and a leveling door when it is rotated upwardly.

9 Claims, 2 Drawing Figures

Figure 1:
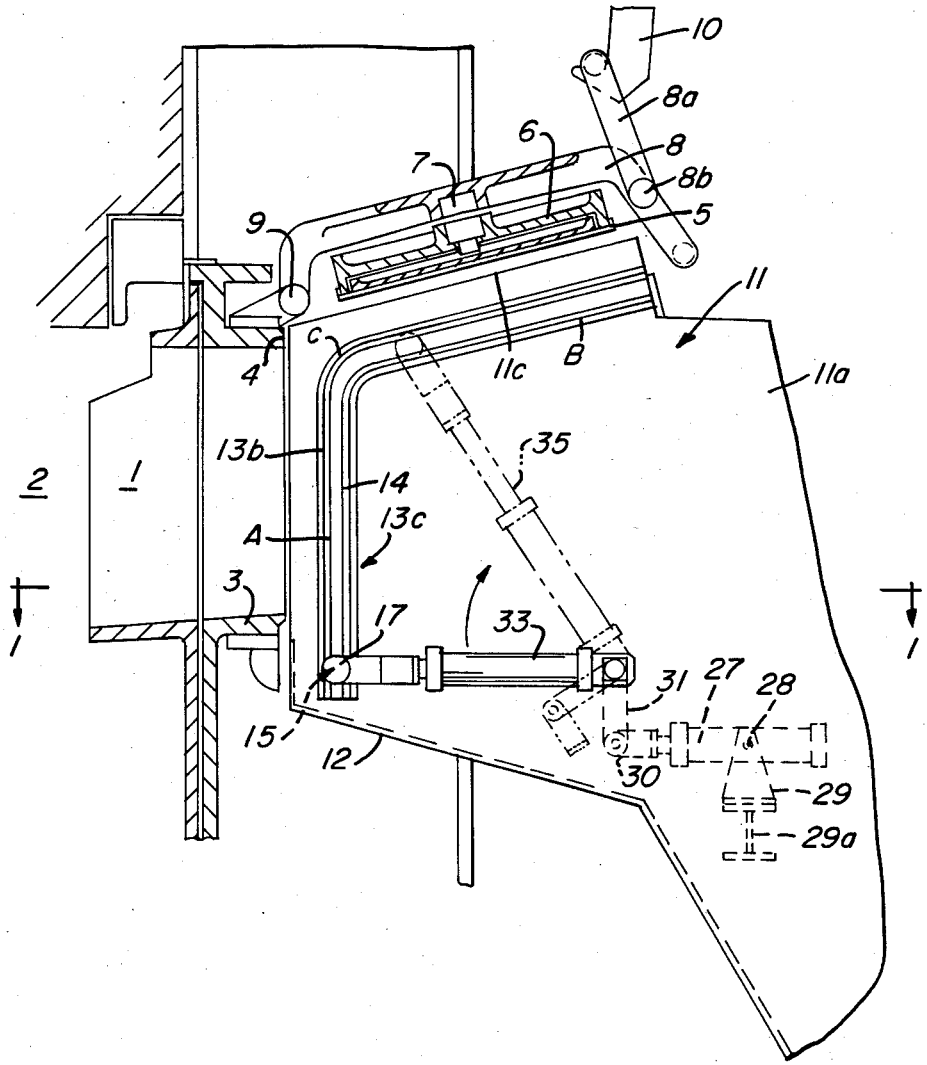

CLEANING APPARATUS FOR THE SEALING SURFACES OF LEVELING DOORS AND LEVELING DOOR FRAMES OF BATTERY-TYPE COKE OVENS

BACKGROUND OF THE INVENTION

As is known, the pusher-side equipment for battery-type by-product coke ovens travels along a track extending parallel to one side of the coke oven battery and includes a pusher for discharging coke from an oven chamber, a leveler, and a door extractor. The door extractor removes and holds the pusher-side coke oven door during a pushing operation. The leveler is adapted to be inserted through a leveling door at the top of each main coke oven door and acts to level the coal within the oven after it is charged from a larry car which travels above the coke oven chambers. Also carried on the pusher-side equipment is apparatus for cleaning the sealing surfaces on the coke oven doors, the leveling doors and the frames against which they abut when closed.

The present invention relates to means for cleaning the sealing surfaces of the leveling doors and leveling door frames through which the leveling element is adapted to extend. Deposits and other unwanted matter unavoidably form on the sealing surfaces of such leveling doors and leveling door frames. These deposits impair the sealing effectiveness of the coking chamber and must, therefore, be periodically removed. In the past, mechanical cleaners have been used for this purpose; however they are very elaborate and increase the overall length of the pusher-side equipment. This is for the reason that in a conventional coke-pushing machine, the distance between the leveling rod, which extends through a leveling door frame, is normally spaced ten oven chambers from the mechanical cleaner. The conventional system also requires that a second leveling door opener be installed. Finally, a disadvantage of conventional systems of the type described above is that high forces must be exerted on the mechanical cleaners to clean the sealing surfaces satisfactorily, with the result that such cleaners are subject to relatively heavy wear.

In the past, the doors and door frames of coking oven chambers have been cleaned with the use of water jets sprayed on the sealing surfaces from nozzles. An example of a system of this type is disclosed in German Patent Specification No. 2,143,595. However, since the main coke oven doors are removed and in the open position when the cleaning operation takes place with all of the sealing surfaces freely accessible, the circumstances are not the same as they are for the leveling doors which are not removed and are normally mounted on hinges.

SUMMARY OF THE INVENTION

In accordance with the present invention, means are provided for cleaning the sealing surfaces of coke oven leveling doors and frames, the cleaning means being adapted to provide thorough and rapid automatic cleaning of the sealing surfaces and to be installed on a coke-pushing machine without any increase in the normal overall length thereof. Furthermore, the invention eliminates the need for a second leveling door opener; and the cleaning means does not increase the oven cycle time.

In a coke oven battery, the leveling doors are rotatable from positions in which they engage the door frames to positions where they are rotated upwardly or outwardly to permit access to a coke oven chamber through the door frame. In the preferred embodiment of the invention described herein, means are carried on a coke-pushing machine for cleaning the sealing surfaces of the leveling doors and leveling door frames which comprises a casing of substantially channel-shaped cross section movable on the pushing machine toward and away from the leveling door frame. The casing has side and bottom walls with forward edges adapted to extend around the leveling door frame together with an open top above which a leveling door is positioned when it is rotated upwardly. Guideways are mounted on the side walls of the casing, each guideway having a first portion extending parallel to the leveling door frame and extending along substantially the entire length of the leveling door frame. Each guideway also has a second portion communicating with the first and extending parallel to sealing surfaces of a leveling door when the door is rotated upwardly to permit access to a coke oven chamber. A carriage extends between and is movable along the guideways, the carriage being provided with liquid nozzles adapted to be directed at the sealing surfaces of the leveling door frame and the sealing surfaces of the leveling door when rotated upwardly. These nozzles are connected through hoses to a supply of high-pressure liquid, the arrangement being such that as the carriage moves along the guideways, high-pressure liquid issuing from the nozzles will clean the sealing surfaces of a leveling door frame and a leveling door rotated upwardly.

Advantageously, the liquid nozzles are disposed in side-by-side relationship on the carriage over a length corresponding substantially to the width of the leveling door frame and the leveling door. The nozzles at the ends of the carriage are adapted to spray cleaning liquid on the side sealing surfaces of the frame and the door; while the intermediate nozzles are adapted to spray cleaning liquid on the top and bottom transverse sealing surfaces of the frame and the door. The nozzles at the ends of the carriage are connected to a first liquid supply line; while the intermediate nozzles are connected to a second supply line. Independently-controlled valves in the first and second supply lines are utilized for controlling the supply of cleaning liquid to the nozzles.

As the nozzle-carrying carriage moves along the guideways, the two groups of nozzles are controlled by the aforesaid valves such that as the nozzles pass the transverse upper and lower sealing surfaces, all nozzles are turned on. However, in-between the upper and lower transverse sealing surfaces, the supply of liquid to the intermediate nozzles is cut off and only the nozzles at the ends of the carriage spray cleaning liquid onto the sealing surfaces which are at right angles to the upper and lower transverse sealing surfaces. In this manner, liquid cannot be sprayed into the oven chamber. The same procedure is followed as the two groups of nozzles pass over the open leveling door in order to spray only the sealing surfaces to be cleaned. Liquid discharged from the cleaning process is collected in the channel-shaped casing and, together with coal issuing from the leveling door frame during a leveling operation, is conveyed to a leveling coal bunker of the machine.

In the preferred embodiment of the invention, the guideways mounted on the side walls of the casing are formed from double bars, the nozzle-carrying carriage being guided by rollers which move between the double bars. Fluid-operated cylinder means is provided for moving the carriage along the guideways. The piston rod of the fluid cylinder is connected through an angle linkage and compression cylinder means to the carriage, the arrangement being such that as the carriage moves along the guideways, the effective length of the compression cylinder means varies.

Figure 2:
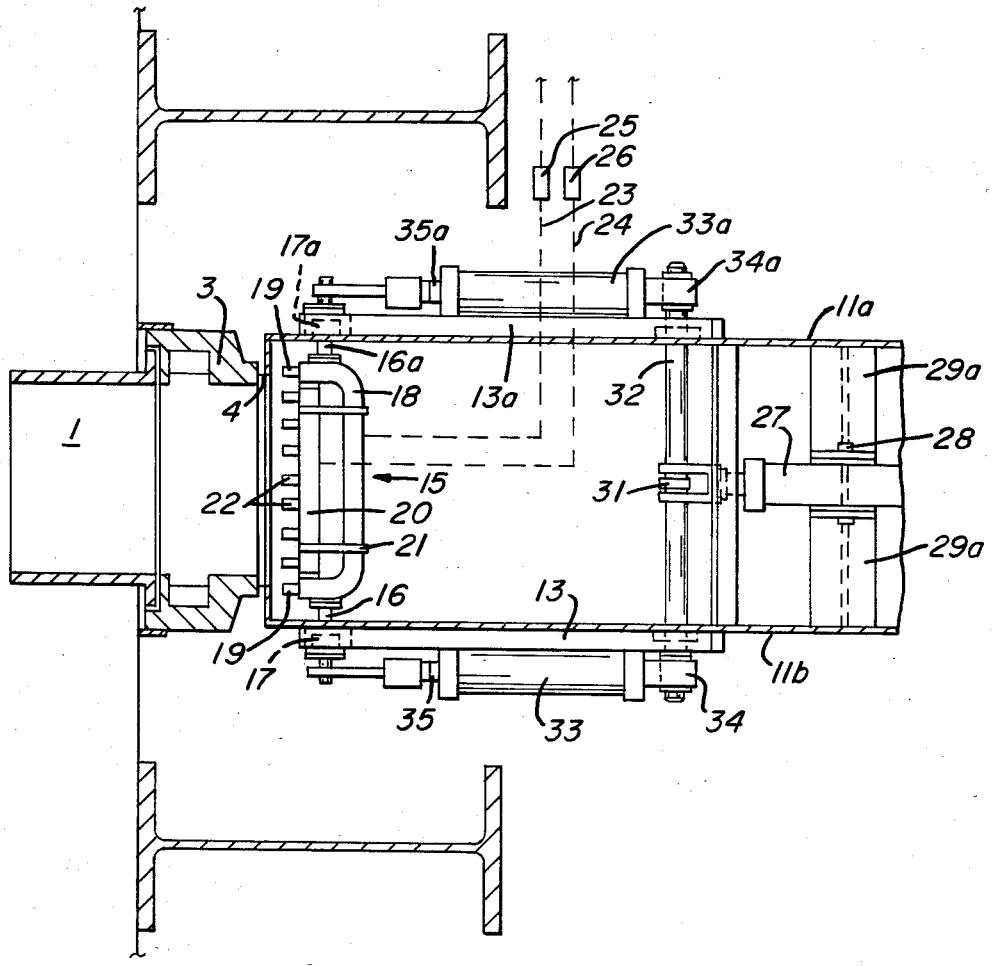

The above and other objects and features of the invention will become apparent from the following detailed description taken in connection with the accompanying drawings, wherein:

FIG. 1 is a vertical cross-sectional view taken through the cleaning apparatus of the invention, the vertical section showing an open leveling door which exposes a leveling door frame; and FIG. 2 is a horizontal cross-sectional view taken substantially along line I—I of FIG. 1.

With reference now to the drawings, there is shown a leveling door opening 1 for a coke oven chamber 2. The opening 1 is bounded by a frame 3 having an end face which forms a sealing surface 4 which cooperates with a corresponding sealing surface 5 of a leveling door 6 shown in FIG. 1 in an open, upwardly-rotated position. It will be appreciated that the sealing surface 5 on the door 6 is pressed against the sealing surface 4 on the frame 3 when the door is closed.

The door 6 is mounted by way of a central intermediate member 7 on a substantially U-shaped member 8 pivotally connected to the door frame 3 about a pivot or hinge 9. A double link **8*a* is connected to the other end of the U-shaped member 8 about a pivot point 8*b*. The upper end of link 8*a* is engaged by a hook 10 of a door opener carried on a coke-pushing machine, not shown. It can be retained in the open position shown, for example, in FIG. 1**.

The cleaning means for the sealing surfaces 4 and 5 comprises a casing 11 of substantially channel-shaped cross section which is movable on the aforesaid coke-pushing machine toward and away from the leveling door frame 3. The casing is preferably formed from steel plate and is provided with side and bottom walls. The bottom wall is inclined downwardly and designated by the reference numeral 12 in FIG. 1; while the side walls are designated as **11*a* and 11*b* (FIG. 2). The casing 11 assumes the position shown in FIGS. 1 and 2 when in the cleaning position and is provided with an open, forward end whose edges abut or surround the lower and side sealing surfaces 4 on the frame 3. The casing 11 is provided with an open top, the upper edge of which is designated generally by the reference numeral 11*c* in FIG. 1. As will be appreciated, the open top of the casing 11 is directly below the leveling door 6 when rotated upwardly about the pivot 9 as shown in FIG. 1. The bottom wall 12 of the casing 11 extends rearwardly from the frame 3 as shown in FIG. 1, initially with a slight inclination and in its trailing portion with an increased inclination to its rearward end. The width of the casing 11, as can be seen from FIG. 2, is greater than the width of the sealing door frame 3**.

Guideways 13 and **13*a* are provided on the outside surfaces of the side walls 11*a* and 11*b* as is perhaps best shown in FIG. 2. Each guideway is preferably formed from a pair of bars or tracks 13*b* and 13*c* separated by a slot 14. Each guideway 13 or 13*a* is provided with a generally vertically-extending portion A which is parallel to the sealing surfaces 4 of the frame 3 and a communicating upwardly-inclined portion B which extends parallel to the sealing surfaces 5 of the leveling door 6 when rotated upwardly into the position shown in FIG. 1. The guideways 13 and 13*a* serve to guide a carriage 15 (FIG. 2) past the sealing surfaces on the frame 3 and door 6. The carriage 15 is provided at its opposite ends with journals 16 and 16*a* (FIG. 2) which extend through slots in the side walls 11*a* and 11*b* and carry rollers 17 and 17*a* which ride within the slots 14 in guideways 13 and 13*a*. The carriage 15, therefore, can move upwardly along portions A of each guideway 13 or 13*a*, then around curves C, and finally along portions B of the guideways. In so doing, it first passes along the sealing surfaces 4 of the frame 3 and then along the sealing surfaces 5 of the door 6**.

As best shown in FIG. 2, the carriage 15 includes a U-shaped tubular member 18, the journals 16 and **16*a* being secured to the end arms on member 18. The forward ends of the tubular member 18 are closed and carry nozzles 19, the spacing between the nozzles 19 corresponding substantially to the spacing between the vertically-extending portions of the sealing surfaces 4 on the frame 3 as well as the side sealing surfaces on the door 6. A straight tubular member 20 extends between the end arms of the U-shaped tubular member 18 and is rigidly connected thereto by means of support plates 21. Liquid nozzles 22 are disposed in side-by-side relationship over the entire length of the tubular member 20 and are used to clean the top and bottom transverse portions of the sealing surface 4 as well as the top and bottom transverse portions of the sealing surface 5 on the door 6. The members 18 and 20, which are hollow and which communicate with the nozzles 19 and 22, respectively, are connected through flexible liquid conduits or hoses 23 and 24, respectively, and through independently-controllable valves 25 and 26 to a supply of high-pressure liquid, not shown. As a result, the respective nozzles 19 at the ends of U-shaped member 18 and the nozzles 22 on tubular member 20** can be connected to the liquid supply independently of one another.

The drive for reciprocating the carriage 15 along the guideways 13 and **13*a* comprises a fluid-operated cylinder 27 pivotally mounted at 28 on a bracket 29 which, in turn, is mounted on an I-beam 29*a* extending between side walls 11*a* and 11*b* of the casing 11. Carried at the forward end of the piston rod of cylinder 27 is a clevis 30 pivotally connected to a link 31. The link 31, in turn, is rigidly secured to a shaft 32 which extends between and is carried within suitable bearings mounted on the side walls 11*a* and 11*b*. The opposite ends of the shaft 32 are rigidly connected to projections 34 and 34*a* on the ends of pneumatic spring-type cylinders 33 and 33*a* carried outside the side walls of casing 11. Cylinders 33 and 33*a* are provided with pistons, under constant pneumatic pressure, which are connected through piston rods 35 to connecting elements pivotally connected to the ends of the journals 16 and 16*a* at the ends of the carriage 15. As a result, the pneumatic spring-type cylinders 33 and 33*a* exert a constant outward pressure on the rollers 17 and 17*a* within the slots 14. In this manner, it will be appreciated that when the cylinder 27 is pressurized to rotate the linkage 31 and shaft 32 in a clockwise direction, the pneumatic cylinders 33 and 33*a* will also rotate in clockwise directions from the full-line position shown in FIG. 1 to the broken-line position wherein the rollers 17 at opposite ends of the carriage 15 are in the slots 14 in portions B of guideways 13 and 13*a*. In this latter position, the nozzles, of course, are adjacent the sealing surfaces 5 of the door 6. Note that in the broken-line position shown in FIG. 1, the piston rod 35 of each pneumatic spring-type cylinder 33 has moved outwardly under the force of the pneumatic pressure therein. In this manner, the carriage 15 initially moves upwardly along guideway portions A, then around the curved portions C, and finally along the portions B. Pressurization of the cylinder 27 in the opposite sense returns the spring-type cylinders 33 and 33***a* and the carriage 15 back into the positions shown by the full lines in FIGS. 1 and 2. In this process, the pressure medium within the cylinders 33 and 33*a* is, of course, compressed.

In the operation of the invention, as the carriage 15 moves upwardly along portions A of guideways 13 and 13*a*, suitable control apparatus, not shown, is provided to open valve 26 only as the nozzles 22 pass the upper and lower transverse portions of the sealing surface 4 on frame 3. On the other hand, valve 25 is controlled such that cleaning liquid is sprayed from nozzles 19 at the ends of the carriage 15 during the entire traverse of the side sealing surfaces of frame 3. The same procedure is followed as the carriage 15 moves along portions B of guideways 13 and 13*a* such that liquid is sprayed from nozzles 22 only at the upper and lower edges of the sealing surface 5 on door 6; while liquid is delivered from nozzles 19 during the entire traverse of the door 6. As mentioned above, the discharging cleaning liquid, together with the cleared deposits, discharges by way of the casing lower wall 12 to a bunker for receiving coal yielded in a leveling operation.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. In a coke oven battery having leveling door frames and leveling doors rotatable from positions in which they engage the door frames to positions where they are rotated upwardly to permit access to a coke oven chamber through the door frame, the combination of means carried on a coke-pushing machine for cleaning the sealing surfaces of said leveling doors and leveling door frames, said cleaning means comprising a casing of substantially channel-shaped cross section movable on the pushing machine toward and away from the leveling door frame and having side and bottom walls with forward edges adapted to extend around the leveling door frame and an open top above which a leveling door is positioned when it is rotated upwardly, guideways mounted on the side walls of the casing, each guideway having a first portion extending parallel to the leveling door frame and extending along substantially the entire length of the leveling door frame, each guideway also having a second portion communicating with the first portion and extending parallel to sealing surfaces of a leveling door when the door is rotated upwardly to permit access to a coke oven chamber, a carriage extending between and movable along said guideways, and liquid nozzles carried on said carriage and adapted to be directed at the sealing surfaces of the leveling door frame and the sealing surfaces of the leveling door when rotated upwardly, the nozzles being connected through hoses to a supply of high-pressure liquid, the arrangement being such that as the carriage moves along said guideways, high-pressure liquid issuing from said nozzles will clean the sealing surfaces of the leveling door frame and the upwardly rotated leveling door.

2. The combination of claim 1 wherein said liquid nozzles are disposed in side-by-side relationship on said carriage over a length corresponding substantially to the width of the leveling door frame and the leveling door, the nozzles at the ends of the carriage being adapted to spray cleaning liquid on the side sealing surfaces of the frame and the door and the intermediate nozzles being adapted to spray cleaning liquid on the top and bottom transverse sealing surfaces of the frame and the door.

3. The combination of claim 2 wherein the nozzles at the ends of the carriage are connected to a first liquid supply line, while the intermediate nozzles are connected to a second liquid supply line.

4. The combination of claim 3 including independently-controlled valves in said first and second supply lines for controlling the supply of cleaning liquid to said nozzles.

5. The combination of claim 4 wherein the valve for controlling the supply of cleaning liquid to said intermediate nozzles is open only when the intermediate nozzles are adjacent the top and bottom transverse sealing surfaces of the frame and door, while the valve for controlling the supply of cleaning liquid to said end nozzles is open as the end nozzles traverse the side sealing surfaces of the frame and door, as well as, the transverse sealing surfaces.

6. The combination of claim 1 wherein said guideways are carried externally on the side walls of the casing, said guideways each being formed from a double bar having a slot therebetween and rollers at the opposite ends of said carriage movable in the slot formed between the double bars of said guideways.

7. The combination of claim 6 including a fluid-operated cylinder means having a piston rod for moving said carriage along said guideways, and an angle linkage and compression cylinder means connecting said piston rod to said carriage, the arrangement being such that as the carriage moves along said guideways, the effective length of the compression cylinder means between the carriage and said angle linkage will vary.

8. The combination of claim 7 wherein said angle linkage is connected to a rotatable shaft extending between the side walls of said casing, and compression cylinders nonrotatably connected to said rotatable shaft and extending between opposite ends of said rotatable shaft and said rollers at opposite ends of said carriage.

9. The apparatus of claim 1 wherein said casing bottom wall is inclined downwardly and away from the leveling door frame.

* * * * *